US005588587A

United States Patent [19]

Stier et al.

[11] Patent Number: 5,588,587

[45] Date of Patent: Dec. 31, 1996

[54] DUAL OVENABLE FOOD PACKAGE

[75] Inventors: David E. Stier, Middletown; Katherine S. Liquori, Goshen, both of N.Y.

[73] Assignee: International Paper, Purchase, N.Y.

[21] Appl. No.: 561,729

[22] Filed: Nov. 22, 1995

[51] Int. Cl.[6] ..... B65D 5/20; B65D 6/06

[52] U.S. Cl. ..... 229/232; 206/557; 229/207; 229/903; 229/906

[58] Field of Search ..... 229/207, 232, 229/902, 903, 905, 906; 206/557; 426/113–115

[56] References Cited

U.S. PATENT DOCUMENTS

| | | | |
|---|---|---|---|
| 3,004,697 | 10/1961 | Stone . | |
| 3,281,051 | 10/1966 | O'Brien . | |
| 3,286,909 | 11/1966 | Scharre . | |
| 3,324,999 | 6/1967 | Farquhar | 426/115 |
| 3,349,985 | 10/1967 | Salway . | |
| 3,394,869 | 7/1968 | Fontana et al. | 229/207 |
| 3,580,466 | 5/1971 | Thelen | 229/207 |
| 3,866,820 | 2/1975 | Zumsteg . | |
| 3,874,548 | 4/1975 | Buff . | |
| 3,899,079 | 8/1975 | Seiter . | |
| 3,938,730 | 2/1976 | Detzel . | |
| 4,043,503 | 8/1977 | Meyers . | |
| 4,202,465 | 5/1980 | McLoren . | |
| 4,221,320 | 9/1980 | Faller . | |
| 4,449,633 | 5/1984 | Johnson . | |
| 4,517,206 | 5/1985 | Murphy et al. | 426/115 |
| 4,529,089 | 7/1985 | Gasbarra . | |
| 4,687,104 | 8/1987 | Ielmini | 229/232 |
| 4,801,017 | 1/1989 | Artuse . | |
| 4,821,884 | 4/1989 | Griffin . | |
| 4,836,383 | 6/1989 | Gordon . | |
| 4,886,170 | 12/1989 | Willey . | |
| 4,919,785 | 4/1990 | Willey . | |
| 5,012,929 | 5/1991 | Roosa | 229/207 |
| 5,078,273 | 1/1992 | Kuchenbecker . | |
| 5,423,449 | 6/1995 | Gordon . | |

FOREIGN PATENT DOCUMENTS

| | | | |
|---|---|---|---|
| 2802328 | 7/1979 | Germany | 206/557 |

*Primary Examiner*—Gary E. Elkins
*Attorney, Agent, or Firm*—Michael J. Doyle

[57] ABSTRACT

A package for either conventional oven or microwave heating of refrigerated or frozen foodstuffs includes an outer paperboard container and an inner food carrying tray or dish. The bottom of the plastic tray rests on the container bottom. The dish is flanged, the flange provided with one or more ears extending downwardly and sandwiched between container side walls. The dish flange is polygonal, having one or more edges abutting respective one or more interior walls of the container. A portion of the top cover of the container is removed by ripping along tear lines. The tear or ripping lines yield four triangular corner sections on the remaining, unripped container top cover, these sections overlying portions of the tray flange. This arrangement prevents the tray from being removed from the container through the top cover access opening defined upon ripping. The construction permits the use of much thinner plastic for the tray since the paperboard container assists in supporting and rigidifying the tray during shipping, storage, and manual handling by the consumer.

7 Claims, 7 Drawing Sheets

DUAL OVENABLE FOOD PACKAGE

BACKGROUND OF THE INVENTION

This invention relates to a package comprising a paperboard container having a plastic dish or tray therein. The tray is typically of molded plastic and its bottom area divided by upstanding walls to define areas or zones containing different foods, as is common with both frozen microwavable and ovenable food packages.

Food containing packages are often marketed in refrigerated or frozen form in paperboard cartons. Consumers need only remove a plastic tray from the carton and heat. While such constructions are convenient, they display the drawback that the dish or tray in which the food in placed must be removed from the paperboard carton or container. This in turn requires that the tray be strong enough to be manually handled and stand by itself in an oven or the like.

SUMMARY OF THE INVENTION

According to the practice of this invention, a food tray fashioned of relatively thin plastic is placed in a paperboard container to define a food package. The container supports the plastic tray at all times, thus permitting the use of thinner plastic and is hence more economical than conventional frozen or refrigerated food packages. The tray has a radially outwardly extending flange provided with one or more outwardly extending ears. The ear folds vertically downwardly and is sandwiched between an upstanding wall of a lower paperboard container section and a depending wall of an upper paperboard section. The sandwiched ear(s) assist in maintaining the dish centrally of the container and locking the plastic tray into the carton insuring that the tray cannot be removed. The top cover of the paperboard container is provided with ripping lines to permit the consumer to rip off a part of the top cover and gain access to the food. The ripping pattern is such that four corner sections on the ripped top cover are directly over portions of the dish flange and thus prevent the dish from separating from the container out of the ripped access opening. Portions of the outer edge of the flange may abut the interior surface of some of the container walls.

DETAILED DESCRIPTION OF THE INVENTION

Figure 1:
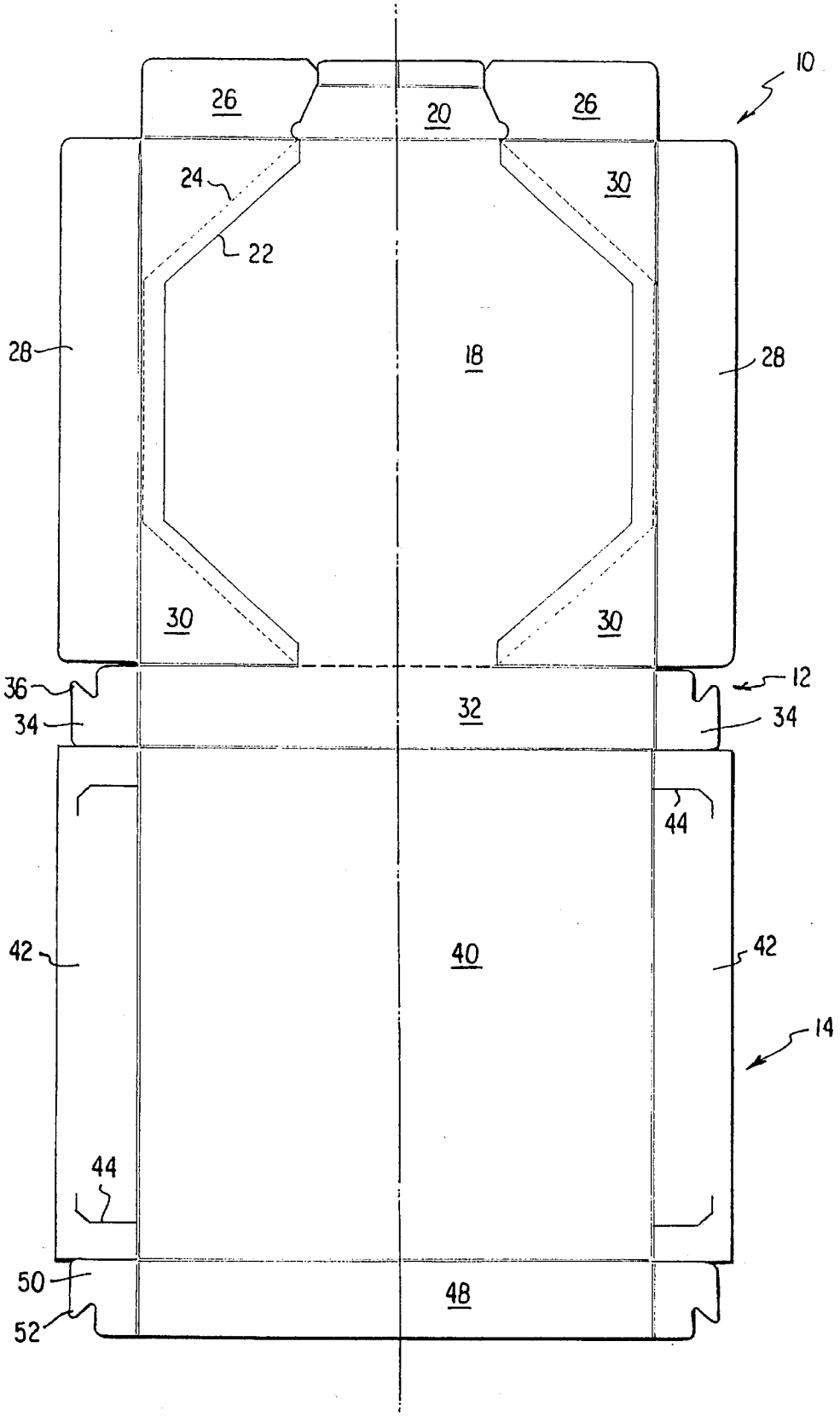
FIG. 1 is a plan view of a unitary blank of paperboard from which the container is formed.

Referring now to FIG. 1 of the drawings, a unitary paperboard blank for forming the container of this invention is shown, the blank including three sections. The upper section is denoted generally as 10, the middle section as 12, and the lower section as 14. One or both surfaces of the blank may be coated with a plastic such as polyethylene. Upper section 10 includes cover panel 18, an opening tongue 20, cut lines 22 and 24 each of which extend partially through the paperboard, but from opposite surfaces. Opening tongue 20 is bordered along the indicated frangible tear lines by two front panel sections 26. Cover side panels 28, of generally rectangular form, are foldably joined to respective right and left edges of panel 18.

Partially cut lines 22 and 24 have respective central portions which run parallel to and border the central vertical sides of panel 18, these cut lines positioned at 45 degrees at the four corners of cover panel 18 although other angles may be employed. Triangular corner regions 30 are defined at the corners by these cut lines.

Middle section 12 includes a common rear wall panel 32 foldably joined to the bottom edge of top cover panel 8, with rear wall panel 32 having latching tongues 34 at each end, each latching tongue carrying a latching point or tip 36. The lower horizontal edge of panel 32 is foldably joined to the top edge of tray bottom panel 40.

Lower section 14 of the blank includes bottom forming panel 40 having side panels 42 of rectangular form foldably joined to respective left and right edges. Each side panel 42 is provided with a pair of vertically spaced cuts 44 for a latching function, as will be explained. The bottom of panel 40 is foldably secured to tray front panel 48, the latter carrying at each left and right end a latching tab 50, each of which includes a latching point 52.

Figures 2, 5:
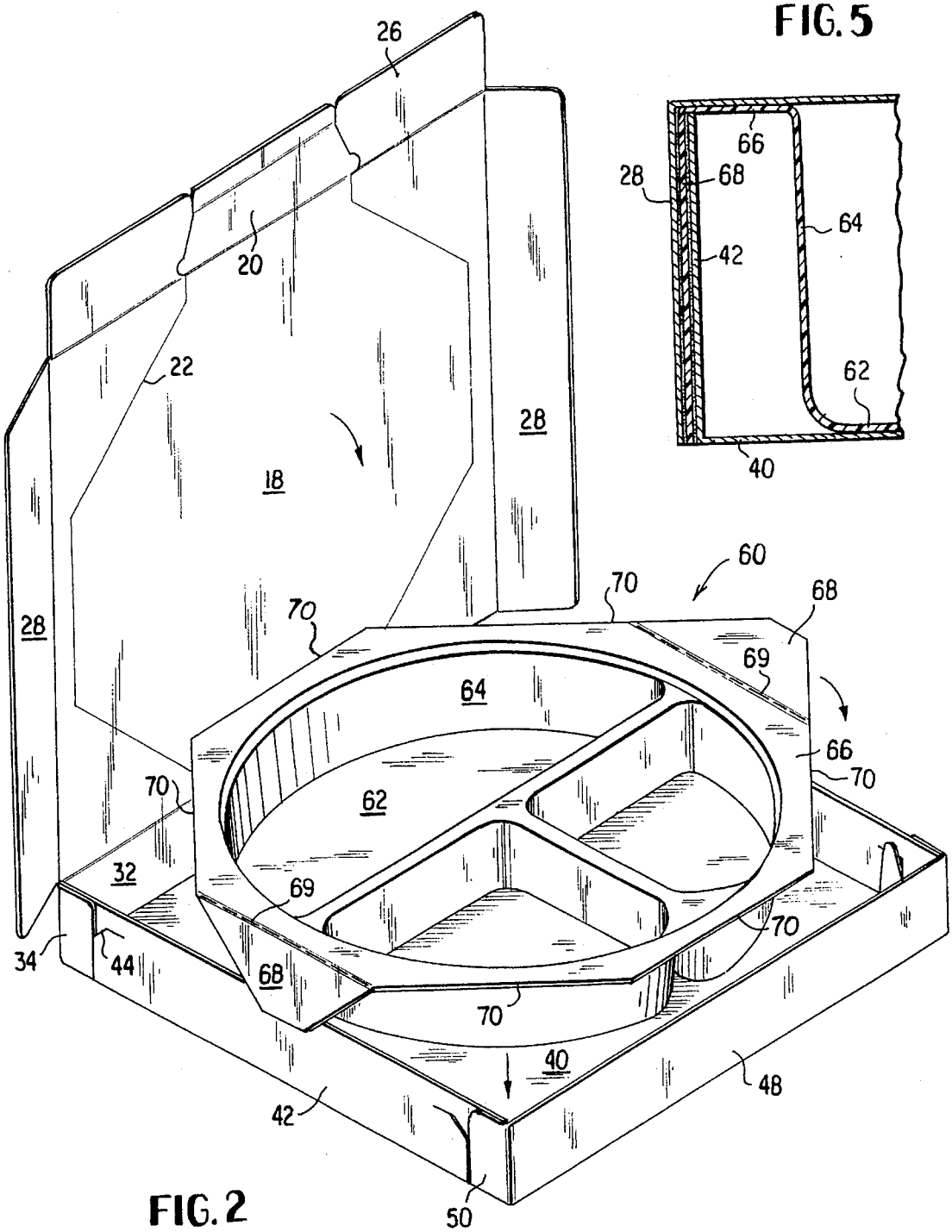
FIG. 2 is a perspective view showing the container blank of FIG. 1 as partially erected and receiving a plastic food tray.
FIG. 5 is a view taken along section 5—5 of FIG. 3.

Referring now to FIG. 2, the blank of FIG. 1 has been folded about several of the indicated horizontal and vertical score lines, with a bottom tray portion of the container formed by latching points 36 of tongues 34 and points 52 of tongues 50 through respective cut lines 44 of panels 42. Glue may be employed instead of tips 36, 52 and slots 44 to effect setting up of the sidewalls. A plastic tray designated as 60 includes a bottom surface 62, side walls 64, upstanding compartment defining walls 65, and a horizontal flange 66. Diametrically oppositely positioned tongues 68 are foldable about fold lines 69, with the periphery of flange 66 having linear edges 70 on each of its eight edges. Opposite edges 70 abut the respective front lower panel 48 and rear panel 32 of the tray. Tongues or ears 68, folded about respective lines 69, extend downwardly and engage the outer surfaces of side walls 42 of the tray. FIG. 2 shows plastic tray 66 just before it reaches its final position with the bottom of tray 62 engaging bottom tray panel 40. While not shown, the reader will understand that the plastic tray contains food. Fold lines 69 are in contact with the upper free edges of side walls 42 although this is not essential.

Figure 3:
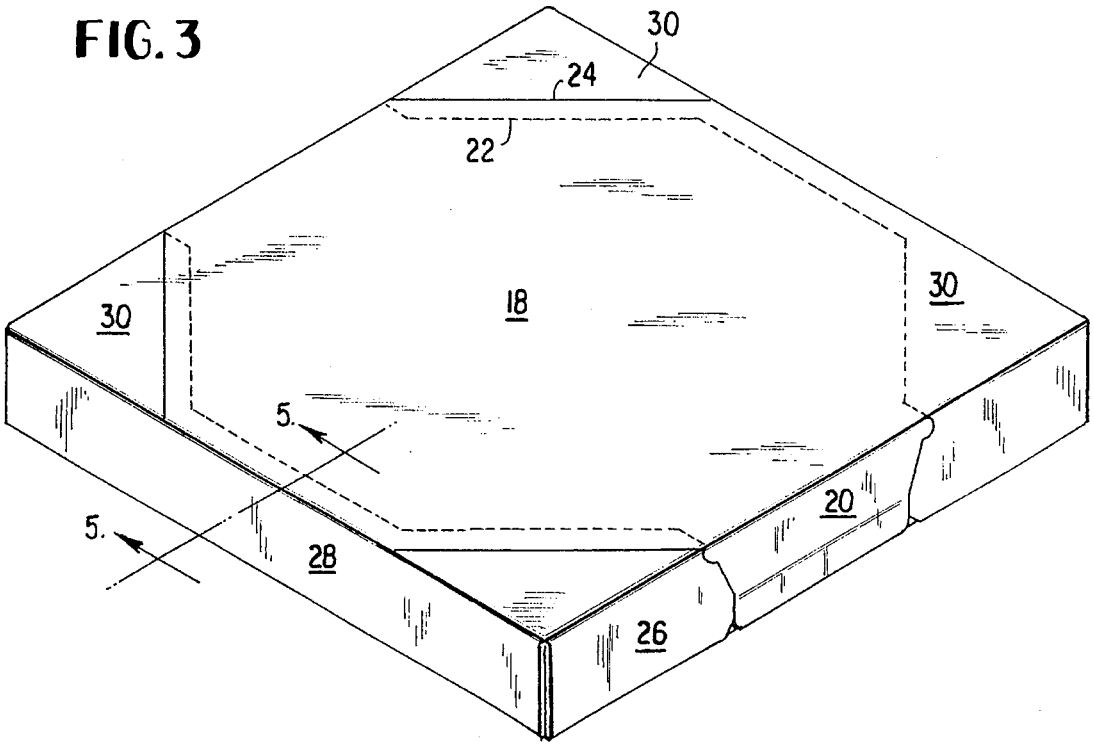
FIG. 3 is a view similar to FIG. 2, showing the container of FIG. 2 in a completely folded or closed condition.

Referring now to FIG. 3, the upper portion of blank 10 has been folded over the open tray, with tray front wall sections 26 and tongue 20 covering front wall 48 of the tray.

Similarly, side walls 28 of the top cover are coextensive with and outside of tray side walls 42.

As shown at FIG. 5, plastic tray tongues 68 are each sandwiched between respective side walls 42 of the tray and side walls 28 of the upper cover or top of the container. FIG. 5 also shows bottom 62 of the plastic tray 60 resting on tray bottom panel 40. Further, cover panel 18 is in contact with the upper surface of plastic tray flange 66.

FIG. 3 illustrates the package after the top cover has been folded down. Front wall sections 26 and tongue 20 of the cover are in surface contact with tray front wall 48, while side walls 28 of the top cover are in surface contact and overlap side walls 42 of the tray. Adhesive or heat sealing may be employed to maintain together the several side and front walls.

Figure 4:
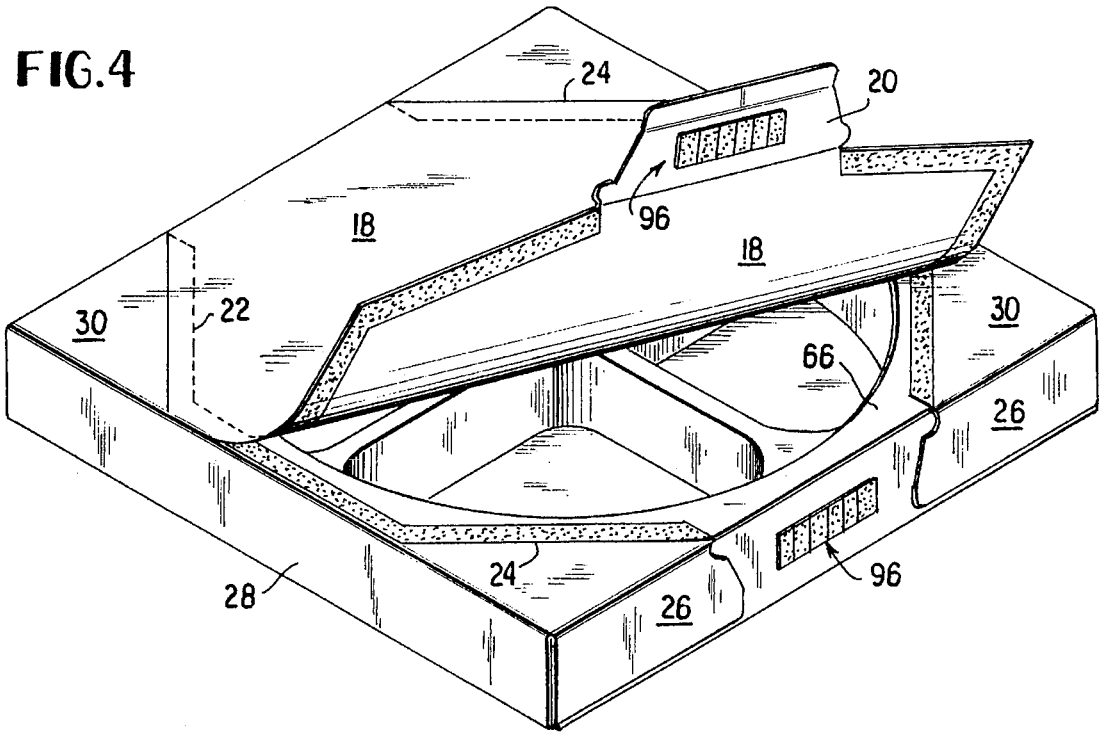
FIG. 4 is a view similar to FIG. 3 and illustrates the step of initiating the opening of the package of FIG. 3.

FIG. 4 illustrates how the package is opened. The user grasps the free edge of opening tongue 20, pulls upwardly, thereby ripping the frangible lines on either side of tongue 20 and completely tearing through partially cut lines 22 and 24 to gain access to the contents of the plastic tray or dish 66. FIG. 4 also illustrates conventional glue and scored areas 96 on tray front wall 48 and the interior surface of tongue 20. Scored areas 96 are conventional and their use is optional in practicing the invention. FIG. 4 also illustrates that corners 30 of the container top cover overlie portions of plastic tray or dish flange 66 to thereby preclude lifting dish 60 out of the opened container. The dish cannot, for example, accidentally be removed from the lower tray of the container even after the access opening in top cover 18 is formed as shown at FIG. 4. Cut lines 22 and 24 may be circular to thus yield a circular access opening upon ripping.

As indicated at FIG. 2, the package is formed by partially completing the outer paperboard container, placing from the open lower tray top a plastic dish or tray with food into the container, then closing the container.

Figure 6:
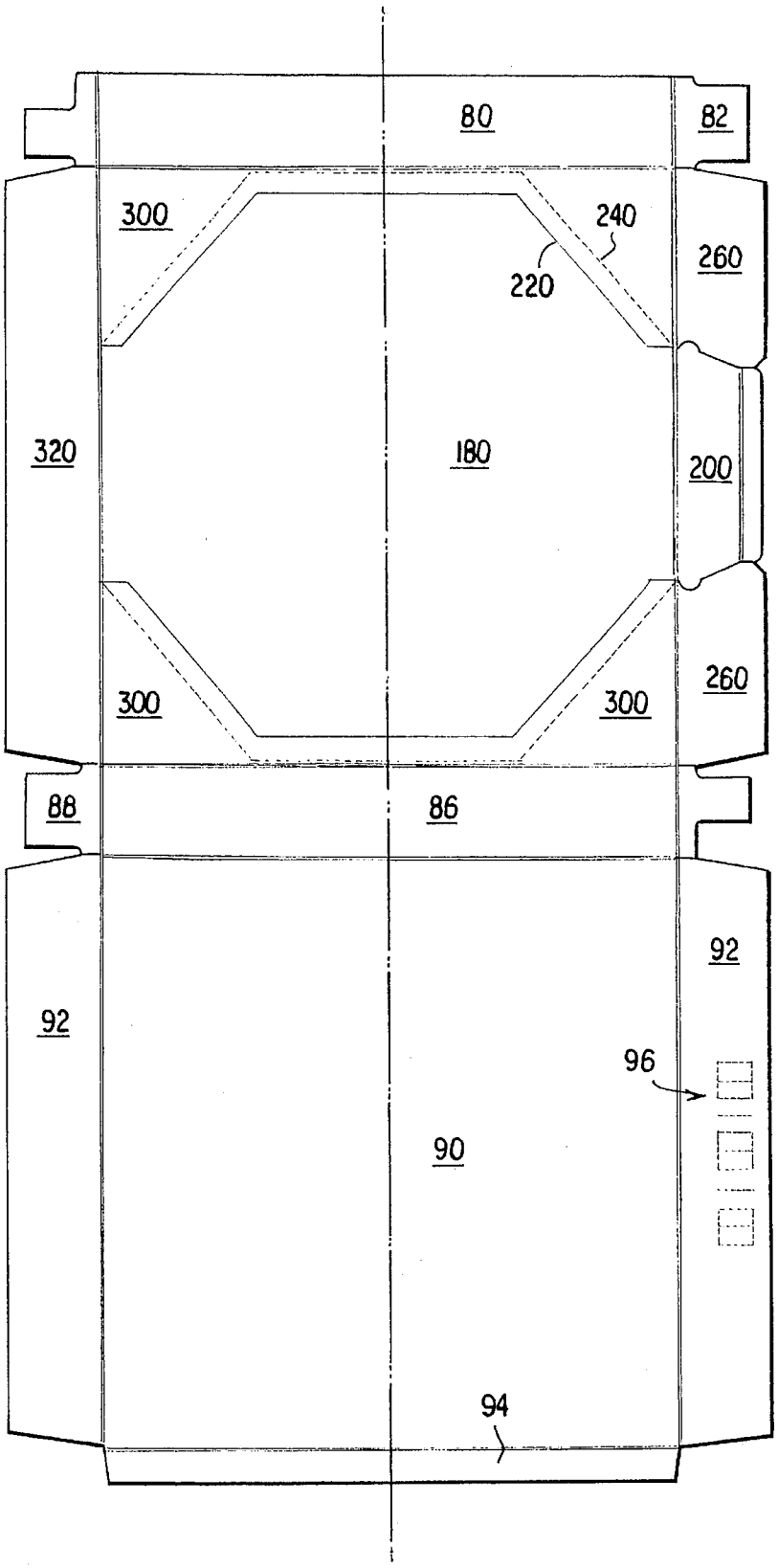
FIG. 6 is a plan view of a unitary blank of paperboard for forming a second embodiment of the container.

FIG. 6 illustrates a unitary paperboard blank for forming an end loading, as opposed to a top loading, outer paperboard container. A top cover forming panel 180 is joined at its uppermost edge to side wall panel 80 having tabs 82 at each end thereof. Similarly, the bottom of panel 180 is provided with a common side wall panel 86 having tabs or panels 88 at each end thereof. A rear wall forming panel 320 is joined to the left edge of panel 180 by the indicated score line, while the right portion of panel 180 is provided with opening tongue 200 which is foldably joined at its edges to front wall forming cover sections 260. Bottom panel 90 is provided on its left and right edges respectively with rear and front panels 92 and at its lower end with glue panel 94. Again, score and glue arrangement 96 may optionally be employed with right lower front wall panel 92 to cooperate with opening tongue 200. Partially cut lines 220 and 240, each extending partially through the paperboard from respective opposite sides of the blank, are of the same form and structure as cut lines 22 and 24 previously described. Heat sealing or glueing to set up and to close the carton is typically carried out on panels 80, 92, 94, 320, 260, and 200.

Figure 7:
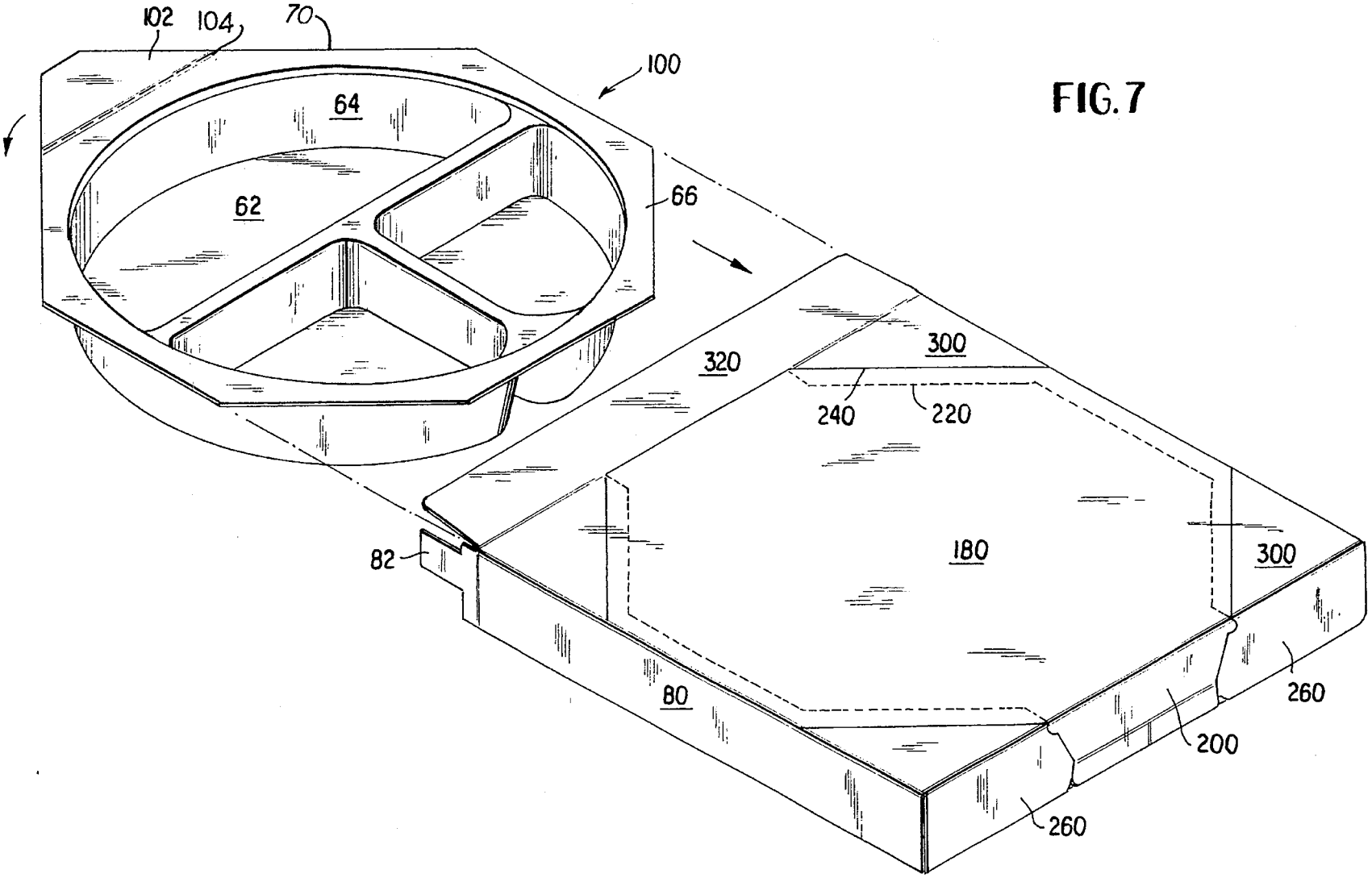
FIG. 7 is a view illustrating the blank of FIG. 6 as being folded to a nearly closed position and illustrating the insertion of a plastic tray into the container prior to final closing.

FIG. 7 illustrates the blank of FIG. 6 as folded and set up, except that side wall panel 320 extending from top cover panel 180 is still open (as is left lower rear wall panel 92) for the purpose of accepting plastic dish or tray 100. One of the dish or tray straight flange free edges 70 typically abuts the interior, double ply thickness, right hand side wall of the container. This tray is similar to that previously described, except that it is provided with only a single dish flange tongue 102 extending out from flange 66 and foldable about line 104. While not illustrated, tray 100 contains food items in its several compartments. Tray 100 is now inserted into the container, with tongue 102 folded on the outside of lower left panel 92 (not illustrated) and with top side wall forming panel 320 folded over tongue 102. After tray insertion, tabs 82 are folded inwardly and panels 92, 320, 260, and 200 joined to each other, with tabs 82 and 88 serving dust panels. Manufacturer's panel 94 is adhered to a portion of side wall forming panel 80 to form a tube structure. The blank may also be plastic coated.

Figure 8:
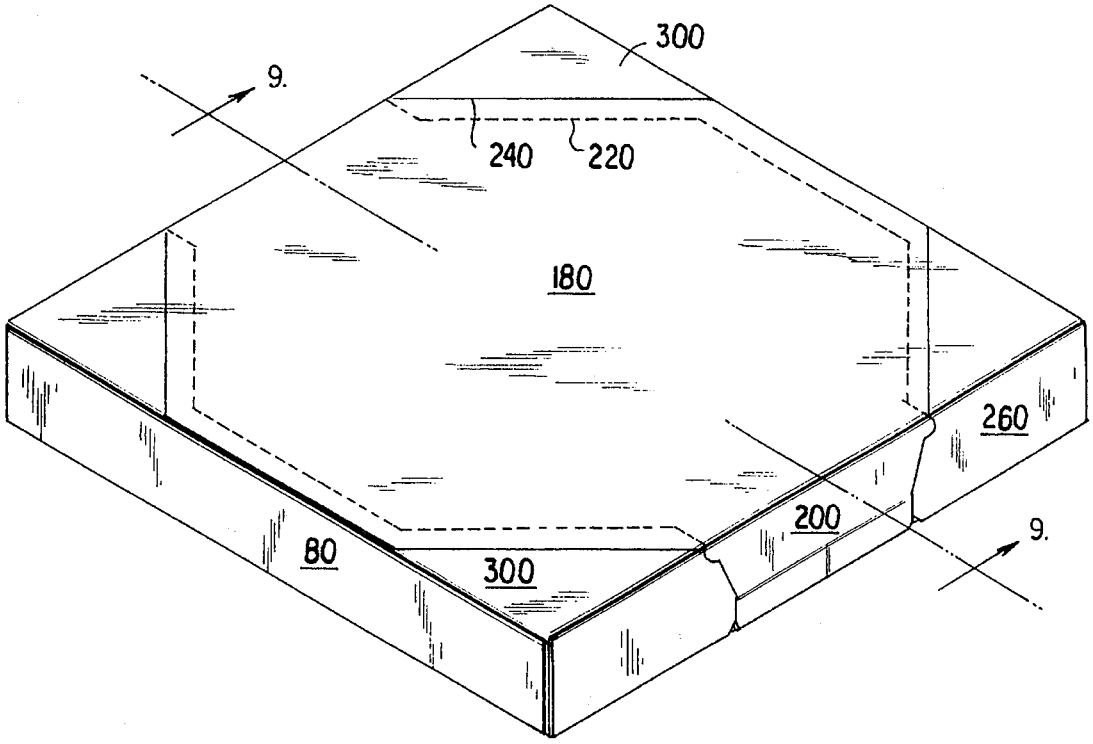
FIG. 8 is a view similar to FIG. 7 and shows the package of this invention when the container is completely sealed and closed.

FIG. 8 illustrates the final configuration of the package prior to opening. The mode of opening is the same as that illustrated in FIG. 4, namely, the user pulls up on opening tongue 200, ripping along the frangible lines adjacent the tongue and along partially cut lines 220 and 240 to gain access to the contents of plastic tray 100.

Figure 9:
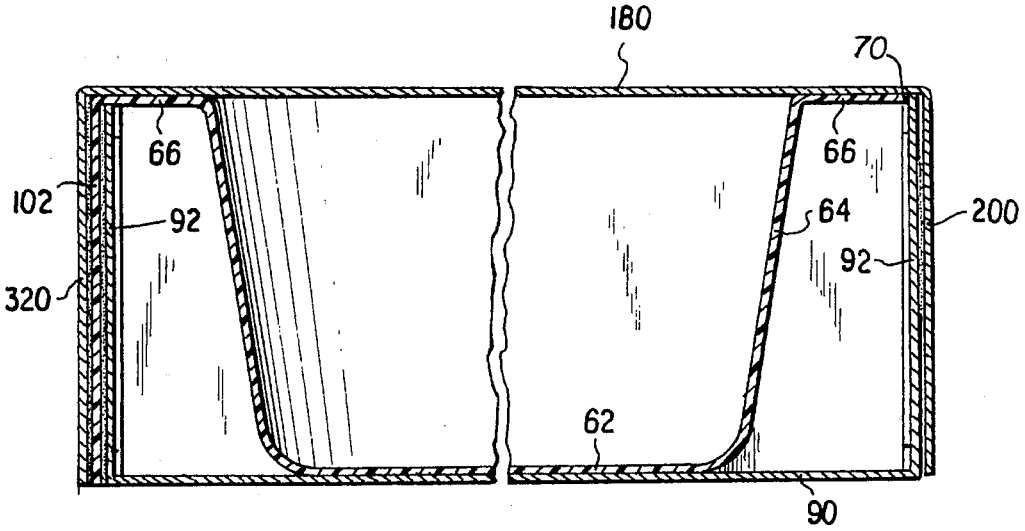
FIG. 9 is a view taken along section 9—9 of FIG. 8.

FIG. 9 illustrates the above described relation of plastic tray tongue 102 relative to rear wall 320 of the top and rear wall 92 of the bottom tray of the container. FIG. 9 also illustrates the abutment of one of free edges 70 of flange 66 against the front of the container. While the use of one (FIG. 7) or two (FIG. 2) tray flange tongues firmly positions the tray within the container and is the preferred mode of carrying out the invention, the tongues may be omitted and each of the four walls of the container may be abutted by a respective free edge 70 to prevent the tray from sliding within the container.

As the package of FIG. 8 is being opened, it will assume the same form as that shown at FIG. 2. The four triangular corners 300 of top cover 180, with tray flange 66, prevent the dish or tray from accidentally being removed from the container interior after ripping off of top cover 180.

Figure 10:
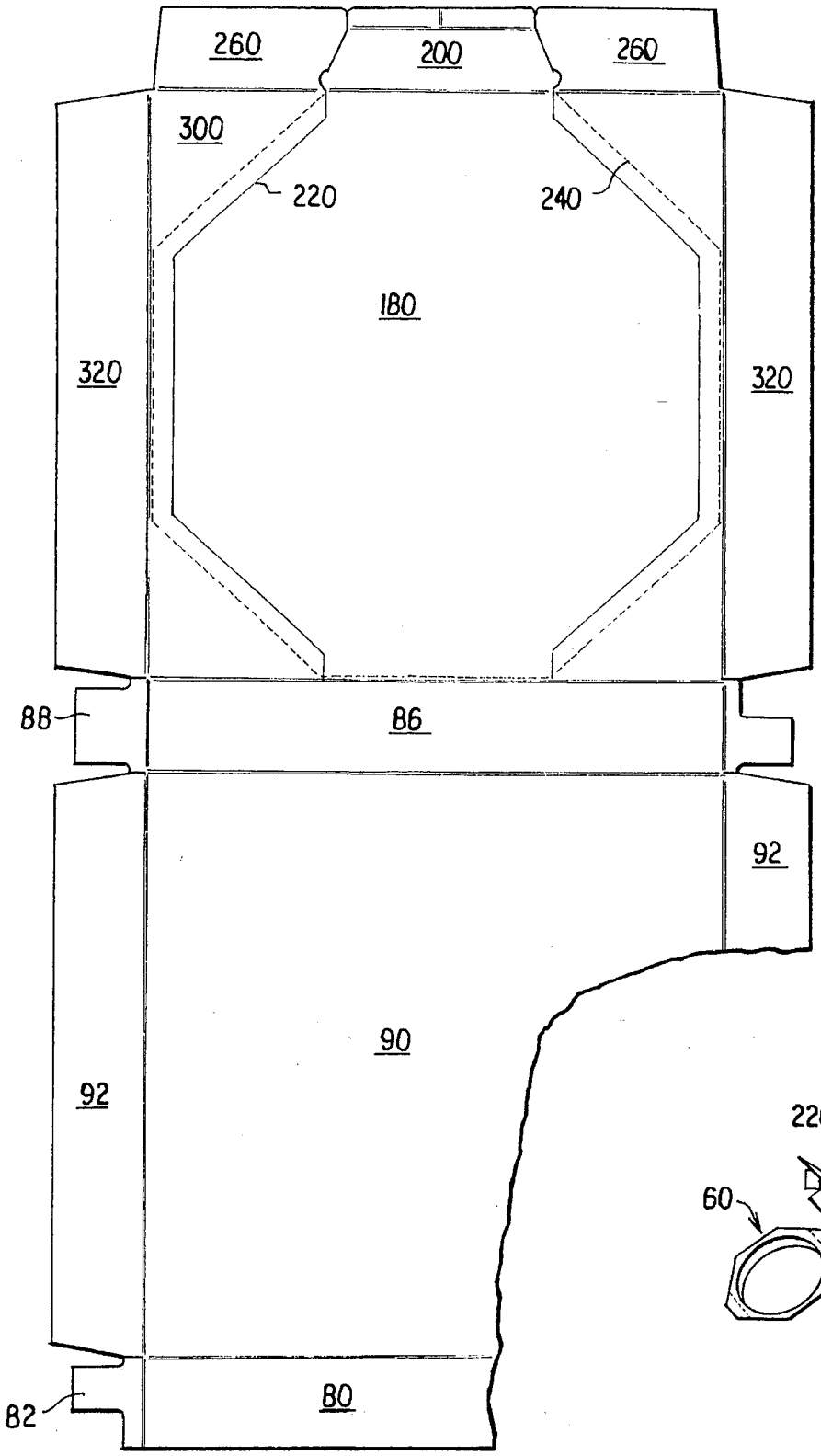
FIG. 10 is a plan view of a unitary paperboard blank for forming a third embodiment of the container.
Figure 11:
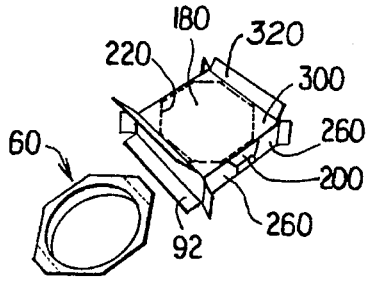
FIG. 11 is partially schematic perspective view showing how a package is formed from the blank of FIG. 10.

Referring now to FIG. 10, a third embodiment of the blank for forming the paperboard container is illustrated. The blank is essentially the same as that shown at FIG. 6, except that the side wall having the rip initiating tongue 200 is located at the top of the blank, taking the place of panel 80, with a second panel 320 (on the right vertical edge of panel 180) taking the place of the shown opening panel 260, 200, 260 of FIG. 6. The rectangular tube shown at FIG. 11 is formed by adhering lowermost panel 80 of FIG. 10 to topmost ripping tongue panel having sections 260, 200, 260. The tube, having open ends, is now ready to receive a plastic food containing dish or tray 60 having two diametrically opposite ears 68, identical to tray 60 of FIG. 2. Tray 60 is inserted into one open tube end, as shown at FIG. 11, such that after full insertion the two flange ears are positioned at the two respective open tube ends. Open tube end closure panels 320 and 92 are folded and adhered together such that each flange ear 68 lies on the outside surface of a respective side panel 92 and on the inside surface of a respective side panel 320. Each ear 68 is thus sandwiched by a respective pair of panels 320 and 92. Such sandwiching is similar to that illustrated at FIG. 5. For consumption of the food product in tray 60, an access opening is formed in top panel 180 by pulling opening tongue 200 and ripping weakened lines 220 and 240, as previously described with respect to FIG. 4. The final package prior to ripping the top panel appears the same as that shown at FIGS. 3 and 8. The embodiment of FIGS. 10 and 11 differs from that of FIG. 2 in the manner of inserting the plastic food tray into the paperboard container. In FIG. 2, the tray is loaded from the top of the open lower container portion and then the top is closed, while in FIG. 11, the tray is loaded from either open tube end and the tube ends closed, either sequentially or concurrently. Similar to the embodiment shown at FIG. 2, fold lines or portions 69 of ears 68 typically contact the free edges of panels 92, although this is not essential. The blank of FIG. 10 may also be coated on one or both surfaces with plastic and other barrier coatings.

In the embodiment of FIG. 1, the direction of ripping of tongue 20 is at right angles to an imaginary axis joining dish flange tongues 68, while in the embodiment of FIG. 10, the direction of ripping of tongue 200 is parallel to an imaginary axis joining the dish flange tongues.

We claim:

1. A container formed from a unitary blank of paperboard and being of generally rectangular parallelepiped form for packaging a food containing dish, the container having a bottom wall, four side walls, and a top wall, one of said container side walls being a first of said container side walls defined by a depending wall from said top wall and an upstanding wall from said bottom wall to thereby define a first container side wall of two plies of paperboard, a dish positioned on said container bottom wall, said dish having a bottom and upstanding side walls, said dish bottom resting on said container bottom wall, said dish having an upper horizontal flange extending radially outwardly therefrom, said horizontal flange having a first radially outwardly extending ear, said a first flange ear being bent downwardly and sandwiched between said two plies of paperboard of said first container side wall, means carried by said container top wall for facilitating ripping off a portion thereof to yield an access opening to said dish, said access opening being smaller in dimension than said dish flange to thereby prevent said dish from being removed from said container after said ripping.

2. The container of claim 1 including a second radially outwardly extending dish flange ear, another of said container side walls being a second of said container side walls defined by a depending wall from said container top wall and an upstanding wall from said container bottom wall to thereby define a second container side wall of two plies of paperboard, said second flange ear being bent downwardly and sandwiched between said plies of said second container side wall.

3. The container of claim 1 wherein said means for ripping includes tear lines which form corners on said container top wall, said corners overlying portions of said dish flange.

4. The container of claim 1 wherein said tray flange has a plurality of straight free edges, at least one of said flange free edges being in abutting contact with at least one of said container side walls.

5. The container of claim 2 wherein said second flange ear is diametrically opposed to said first flange ear.

6. A paperboard container of generally rectangular parallelepiped form for packaging a food containing dish, the container having a bottom wall, four side walls, and a top wall, one of said container side walls defined by a depending wall from said top container wall and an upstanding wall from said bottom container wall to thereby define a first container side wall of two plies of paperboard, a dish positioned on said container bottom wall, said dish having a bottom wall and upstanding side walls, said dish bottom resting on said container bottom wall, said dish having an upper radially outwardly extending ear, said dish ear being bent downwardly and sandwiched between said two plies of paperboard of said first container side wall, means carried by said container top wall for facilitating ripping off a portion thereof to yield an access opening to said dish.

7. The container of claim 6 wherein said container is formed of a unitary blank.

* * * * *